United States Patent [19]

Gordon et al.

[11] 4,131,369

[45] Dec. 26, 1978

[54] CENTRIFUGAL HOMOGENIZER

[76] Inventors: Manfred Gordon, 11 Belle Vue Rd., Wivenhoe, nr. Colchester, Essex; Bernard W. Ready, 22 Wesley Ave., Colchester, Essex, both of England

[21] Appl. No.: 819,454

[22] Filed: Jul. 27, 1977

[30] Foreign Application Priority Data

Aug. 6, 1976 [GB] United Kingdom ..... 32833/76

[51] Int. Cl.[2] ..... B01F 9/00; B04B 1/00; B04B 9/08

[52] U.S. Cl. ..... 366/146; 233/3; 233/25; 366/220

[58] Field of Search ..... 366/144, 146, 220, 232; 233/5, 63, 25, 26

[56] References Cited

U.S. PATENT DOCUMENTS 3,199,775 8/1965 Drucker ..... 233/25

3,882,716 5/1976 Beiman ..... 233/25

3,986,442 10/1976 Khoja ..... 233/25

*Primary Examiner*—Edward J. McCarthy

*Attorney, Agent, or Firm*—Kemon & Estabrook

[57] ABSTRACT

A method of mixing a composition in the liquid state comprises enclosing the compositin in a tube, locating the tube in tube location means rotatably mounted on a member, spinning the member about a spin axis, and for at least part of the spinning period rotating the tube location means about its own axis of rotation parallel to the spin axis and spaced therefrom, so that the tube is subjected to both spinning and end-to-end rotation.

Apparatus for carrying out the method preferably comprises a sun and planet gear assembly which rotates on the spin axis, the tube location means being coupled to planet gear of the assembly so that rotation of the assembly causes the spinning of the tube, and relative rotation between the sun and planet gears causes the end-to-end rotation of the tube.

10 Claims, 6 Drawing Figures

CENTRIFUGAL HOMOGENIZER

Figure 1A:
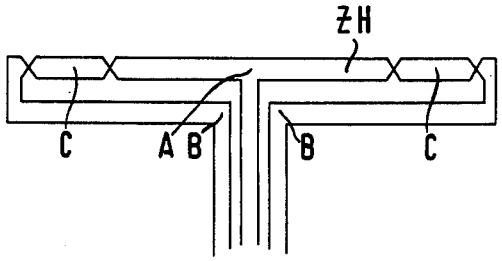

This invention relates to a centrifugal homogenizing method and apparatus which have been developed to meet the need for rapid and efficient mixing of viscous compositions in the liquid state such as polymer solutions, normally in milligram quantities, under controlled atmosphere and prescribed temperature schedules.

In particular, the preparation of test samples of polyolefine solutions has to be carried out at high temperature (150–200° C.) in the absence of oxygen. It is found difficult to mix such solutions in quantities of a few milligrams because of their high viscosity.

It is an object of the invention to provide an improved method and apparatus for mixing liquid compositions.

According to one aspect of the invention, a method of mixing a composition in the liquid state comprises the steps of:

enclosing the components of the composition in a tube;

positioning the tube by tube location means carried by a member which is mounted for spinning about a spin axis, the tube location means being mounted for rotation relative to the member about an axis of rotation substantially parallel to said spin axis and spaced therefrom; and spinning the member about said spin axis for a period of time and rotating the location means about said axis of rotation for at least part of the spinning period;

whereby the tube is subjected to spinning about said spin axis of the member, and to end-to-end rotation about said axis of rotation of the tube location means.

Preferably the rotation of the tube location means about its axis of rotation comprises rotation of about 180° in one direction followed by a returning rotation of about 180°.

According to another aspect of the invention, apparatus for mixing a composition in the liquid state comprises:

a tube for enclosing the composition;

a member rotatable about a spin axis;

tube location means for receiving the tube;

means mounting the tube location means for rotation relative to the member about an axis of rotation substantially parallel to said spin axis and spaced therefrom;

means to cause the member to spin for a period of time about said spin axis; and means to cause rotation of the tube location means about said axis of rotation for at least part of the spinning period;

whereby the tube is subjected to spinning about said spin axis of the member and to end-to-end rotation about said axis of rotation of the tube location means.

Preferably the member comprises a sun gear rotatable about said spin axis; the means to cause rotation of the tube location means comprises a planet gear meshed with the sun gear, the tube location means being coupled to the planet gear; and preferably the apparatus further comprises means to rotate the sun gear and the planet gear together about said spin axis and operable to cause relative rotation between the planet gear and the sun gear to rotate the tube location means about said axis of rotation.

The principle of the centrifugal homogenizer is the use of centrifugal force in generating the shearing forces required for mixing. The additional end-to-end rotation of the tube causes the liquid composition to flow from one end of the tube to the other end under centrifugal force with a moderately high shearing force.

The closed tube or "cell" containing the sample can be directly used for measurements on the polymer or other solution prepared by the centrifugal homogenizer, or it may be opened and the solution used for various test purposes.

Considering the first of these applications, as an example of a direct measurement without removing the cell from the centrifugal homogeniser instrument, the phase-volume ratio method for measuring critical points may be mentioned (see R. Koningsveld and A. J. Staverman, J. Polymer Sci., C16, p. 1775–1786, 1967). This relies on measurement of the volumes of the two phases into which a given solution separates at various temperatures below its cloud point. The volumes of the phases can be measured directly in terms of the lengths of the two liquid columns in the capillary cell, which are separated after centrifugation (without the planetary motion of the present invention) by a visible interface meniscus. Without removing the cell from the centrifugal homogeniser, it can then be re-homogenized by centrifugation with the planetary motion after re-heating above the cloud point. The re-homogenization of the two liquid phases is effected in 1 or 2 minutes. The cell is then cooled in the instrument to another measured temperature below the cloud point, when phase separation again occurs. The two phases are again separated into two liquid columns, and their volume ratio measured as before. The determination of the critical point depends on plotting the ratio of the volumes (or lengths) of the two columns as a function of the temperature. The centrifugal homogenizer of the present invention allows the same cell to be used for successive measurements at different temperatures, which represents increased precision, and also saving of labor previously expended in preparing separate cells containing solutions of the same composition.

As a specific example of the second exemplary application, i.e., preparing homogeneous solutions for subsequent tests in other apparatus, we cite the case of refractive index measurements or gel chromotography. Here micro amounts of solution are generally required. Typically, a 10 mg sample of a 2% solution of polystyrene ($M_w$ = 500,000) in cyclohexanol can be homogenized in vacuo at 50° C. in about 10 minutes using the present centrifugal homogenizer. During this period the material is not exposed to any dangers of contamination or loss of solvent, nor are the shearing forces so high as to cause degradation by chain splitting.

Figure 1B:
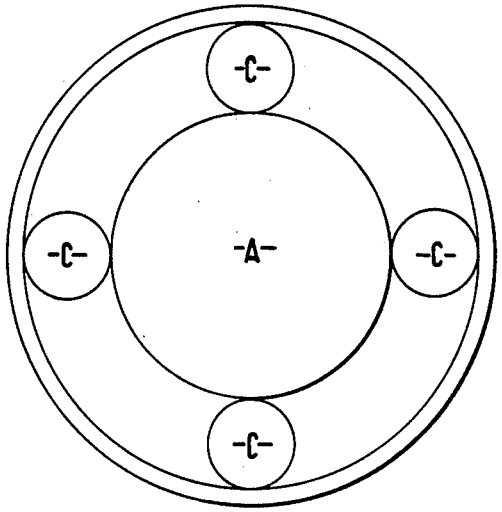
Figure 2:
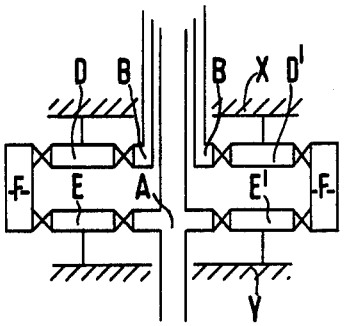
Figure 3:
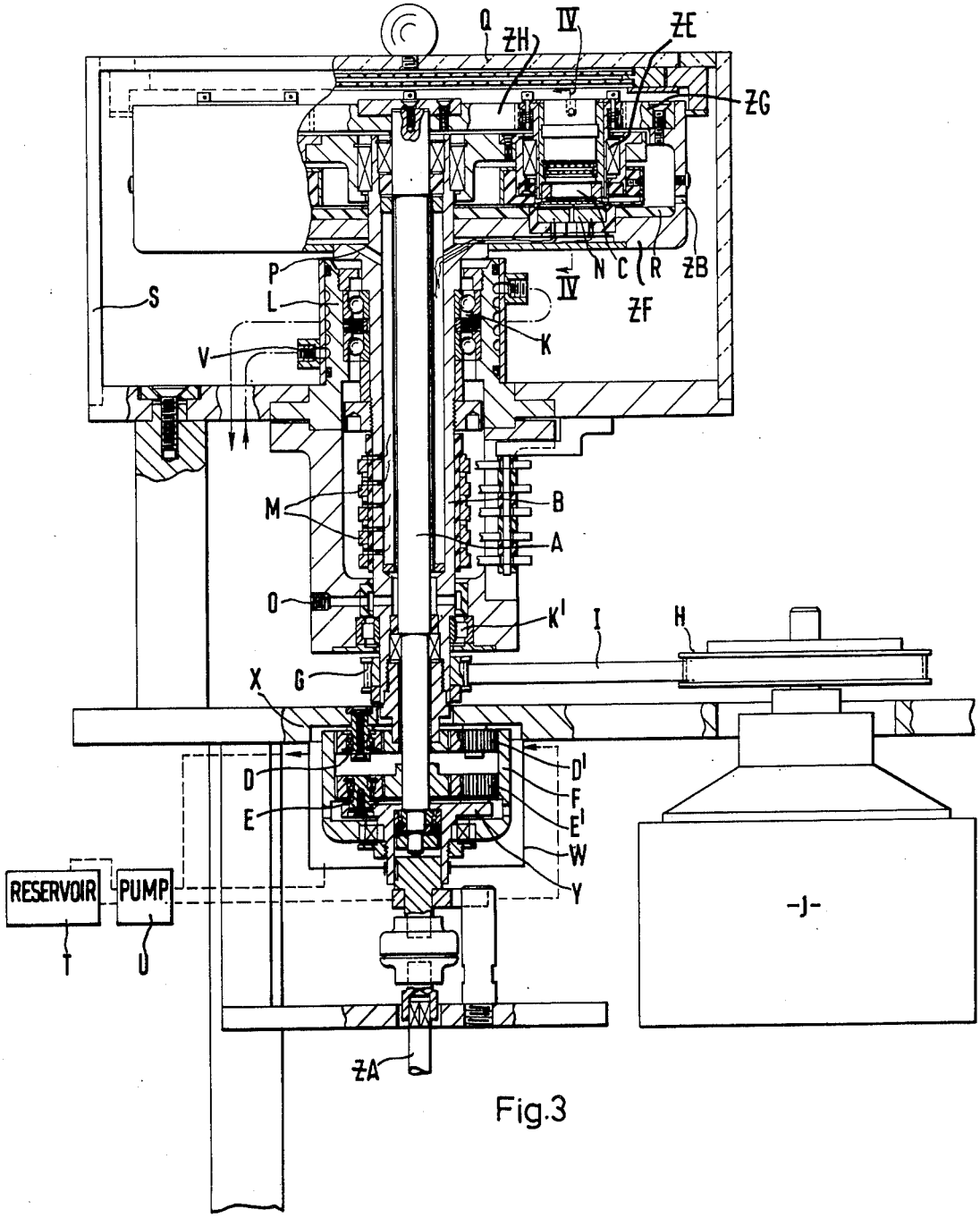
Figure 5:
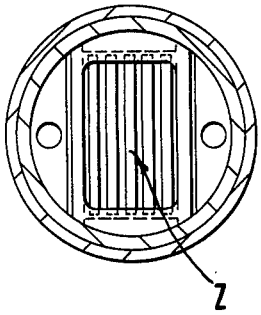
Figure 4:
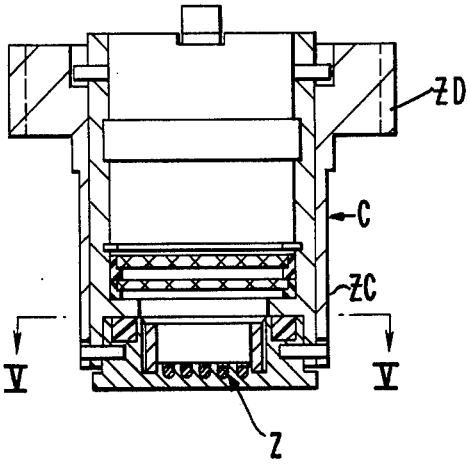

An embodiment of the invention will now be described, by way of example, with reference to the accompanying drawings, in which:

FIGS. 1*a* and 1*b* are schematic sectional and plan views, respectively, of a cell mounting within the configuration of a sun and planet gear assembly, FIG. 2 is a schematic sectional view illustrating the principle of a drive transmission for the concentric drive shafts of the sun and planet gear assembly, FIG. 3 is a cross section of a complete homogenizer in accordance with the invention, FIG. 4 is a cross section of a cell holder taken on a line IV—IV of FIG. 3, and FIG. 5 is a cross section of the cell holder taken on a line V—V of FIG. 4.

Referring to FIG. 1*a* and FIG. 1*b* of the drawing, two concentric drive shafts A and B normally rotate synchronously at up to 6000 rpm. Cell holders C comprise geared planetary discs which are in mesh with the drive shaft A via a central (sun) gear wheel ZH. The cell holders are connected to the outer drive shaft B either by means of ball bearing mounts (not shown) which define the axes of rotation of the cell holders and by an outer ring gear, or solely by means of an outer ring gear. When the drive shafts A and B rotate synchronously about the central axis of spin, the sun and planet components of this system maintain fixed positions relative to each other. The cells therefore do not rotate about the axes of rolation of the cell holder, but merely spin about the axis of the shafts A and B. However, any rotation of the shaft A with respect to the shaft B causes each planetary disc C to rotate about its axis.

If the axis of rotation is not defined by ball bearing mounts, then rotation of the cells will be accompanied by displacement of the cell holder along a circle centred on the axis of spinning, so that the cell holder precesses. This precessional feature of the sun and planet principle is important in some applications of the invention.

The principle of a drive transmission for the shafts A and B is shown schematically in FIG. 2. Spur gears D and D' are fixed on ball bearing mounts to a normally stationary member X, while gears E and E' are similarly fixed to a parallel normally stationary member Y. The end of the shaft B has gear teeth thereon to mesh with the gears D and D'. Similarly, teeth on the shaft A mesh with the gears E and E'.

If the shaft B is driven directly by means of an electric motor, then the shaft A is driven synchronously with the shaft B and in the same direction via a ring gear F which meshes with the gears D, D' E and E'. By rotating the member X through some fixed angle relative to the member Y, the drive shafts A and B will also rotate through a fixed angle relative to each other. By this means, the cell holders are rotated about their axes by any chosen degree in a manner which is independent of the rotation about the central axis of spinning. The rotation is preferably an intermittent 180° rotation.

Each of the cell holders C can accommodate several capillary cells so that the contents of the cells can be homogenized simultaneously.

FIG. 3 is a cross sectional view of a preferred form of a homogeniser in accordance with the invention. In this Figure, components corresponding to those in FIGS. 1 and 2 have been given the corresponding references.

Each cell holder C (see also FIG. 4) comprises an outer cylinder ZC integral with an annular gear ZD. The cylinder ZC is arranged to rotate in a bearing ZE mounted on a rotor ZF which is keyed to the shaft B and carries the outer ring gear ZG. The gear ZD meshes with the gear ZG and with the sun gear ZH.

The shaft B is driven by a motor J via pulleys G and H and a belt I. The shaft is journalled in bearings K and K' within a stationary housing L. Slip rings M are provided on the shaft B for supplying electrical power to cell heaters N mounted beneath the cell holders C and for feeding back data relating to the temperature of each cell. The cells under test may alternatively be cooled by feeding coolant to the vicinity of the cell holders via an inlet O, the hollow shaft B and ducts P. The centrifuge rotor (i.e., the sun and planet wheels, their supports, and the cell holders) is contained within a stationary cylindrical casing S, preferably formed of a transparent material such as polycarbonate, which is closed by a transparent cover Q, so that the rotor is totally enclosed. Thermally insulating material R is provided beneath the cell holders to reduce heat loss to the rest of the rotor. The precessional feature of the cell holder is exploited to translate the cell between different regions of the cell heater, such regions being individually temperature controlled. In this way the cell content is submitted to controlled thermal pulses if desired.

Oil from a reservoir T is fed under pressure by a pump U to an inlet V of a helical duct in the housing L around the location of the bearing K. Oil is similarly fed under pressure to a housing W containing the gears D, D', E,E' and F.

In use of the homogenizer, cells Z (FIGS. 4 and 5) containing the liquids to be mixed are placed in the cell holders, the holders are locked into the rotor, and the cover Q is fitted. The shaft B is driven by the motor J so that the rotor spins at, say, 6000 rpm. If the spider Y on which the gear wheels E and E' are rotatably mounted is held stationary (the member X also being stationary because it is a fixed platform) the cell holders spin about the axis of the shafts A and B, but do not themselves rotate relative to the rest of the rotor. However, if a shaft ZA coupled to the spider Y is rotated, for example by hand or by a hydraulic or other mechanical rotary actuator, the relative movement between the members X and Y will, as previously explained with reference to FIGS. 1 and 2, cause the planet wheels, and hence the cell holders, to rotate about their own vertical axes. The speed and the duration of this rotation are, of course, dependent upon the speed and duration of the rotation of the shaft ZA. In practice, a backwards and forwards cell holder rotation of 180° in several seconds is found to be suitable.

As the rotor spins, the cells can be inspected using a stroboscope synchronized to the speed of rotation of the rotor. A laser beam may be fed to each cell position, via an aperture ZB, for carrying out scatter or other measurements on the samples in the cells.

Clearly, modifications to the apparatus can be made without departing from the scope of the invention. For example, it is not essential for the cell holders to be attached directly to the planet wheels. They could be separate units driven by the planet wheels via gearing or belt drives. Any desired number of cell holders could be provided instead of the four used in the described embodiment.

Although the sun and planet wheel arrangement described above is a very convenient mechanism for imparting the spinning and intermittent cell rotation motions to the cells, alternative arrangements could clearly be used. For example, the spinning motion could be provided by a motor driving a centrifuge arm, whilst the cell rotation could be imparted by a separate electric or other motor on the arm driving one or more of the cell holders.

The apparatus is suitable for mixing many different compositions of liquids, or liquids and solids, but any such composition must be in a liquid state.

We claim:

1. A method of mixing a composition in the liquid state, comprising the steps of:

enclosing the components of the composition in a tube;

positioning the tube by tube location means carried by a member which is mounted for spinning about a spin axis, the tube location means being mounted for rotation relative to the member about an axis of rotation substantially parallel to said spin axis and spaced therefrom; and spinning the member about said spin axis for a period of time and rotating the location means about said axis of rotation for at least part of the spinning period;

whereby the tube is subjected to spinning about said spin axis of the member, and to end-to-end rotation about said axis of rotation of the tube location means.

2. A method as claimed in claim 1, wherein the rotation of the tube location means about its axis of rotation comprises rotation of about 180° in one direction followed by a returning rotation of about 180°.

3. Apparatus for mixing a composition in the liquid state, comprising:

a tube for enclosing the composition;

a member rotatable about a spin axis;

tube location means for receiving the tube;

means mounting the tube location means for rotation relative to the member about an axis of rotation substantially parallel to said spin axis and spaced therefrom;

means to cause the member to spin for a period of time about said spin axis; and means to cause rotation of the tube location means about said axis of rotation for at least part of the spinning period;

whereby the tube is subjected to spinning about said spin axis of the member and to end-to-end rotation about said axis of rotation of the tube location means.

4. Apparatus as claimed in claim 3, wherein said member comprises a sun gear rotatable about said spin axis; and wherein the means to cause rotation of the tube location means comprises a planet gear meshed with the sun gear, the tube location means being coupled to the planet gear; the apparatus further comprising means to rotate the sun gear and the planet gear together about said spin axis and operable to cause relative rotation between the planet gear and the sun gear to rotate the tube location means about said axis of rotation.

5. Apparatus as claimed in claim 4, wherein the means operable to cause relative rotation between the planet gear and the sun gear comprises a ring gear coaxial with the sun gear and meshing with the planet gear.

6. Apparatus as claimed in claim 5, further including a gear assembly coupled to the sun and planet gears and including two bodies relative rotation of which causes said relative rotation between the planet gear and the ring gear.

7. Apparatus as claimed in claim 6, wherein said gear assembly comprises first and second sun and planet gear assemblies, with the planet gears of the two assemblies meshing with a common outer ring gear; the apparatus further including a first shaft rotatable about said spin axis and coupled to that planet gear which causes rotation of the tube location means; means to drive said first shaft; a second shaft rotatable about said spin axis and coupled to the first-mentioned sun gear and to the sun gear of said second assembly; said two bodies comprising first and second, bodies on which the planet wheels of said first and second assemblies, respectively, are rotatably mounted.

8. Apparatus as claimed in claim 7, wherein said first bodies is maintained stationary and said second bodies is rotatable for imparting said relative rotation.

9. Apparatus as claimed in claim 7, including electrical heating means mounted adjacent the tube location means for heating the tube.

10. Apparatus as claimed in claim 9, including slip rings mounted on one of said shafts for supplying electrical power to the heating means.

* * * * *